US009938941B2

(12) United States Patent
Fischer et al.

(10) Patent No.: US 9,938,941 B2
(45) Date of Patent: Apr. 10, 2018

(54) FUEL INJECTION SYSTEM HAVING A FUEL-CARRYING COMPONENT, A FUEL INJECTOR AND A CONNECTING ELEMENT

(71) Applicant: Robert Bosch GmbH, Stuttgart (DE)

(72) Inventors: Michael Fischer, Niefern-Oeschelbronn (DE); Michael Knorpp, Weissach (DE); Martin Riemer, Untergruppenbach (DE); Hans-Georg Horst, Leonberg (DE); Andreas Glaser, Stuttgart (DE); Philipp Rogler, Stuttgart (DE); Jan Herrmann, Stuttgart (DE); Andreas Rehwald, Bietigheim-Bissingen (DE); Michael Mayer, Wannweil (DE); Volker Scheef, Ludwigsburg (DE); Wilhelm Reinhardt, Oetisheim (DE)

(73) Assignee: ROBERT BOSCH GMBH, Stuttgart (DE)

( * ) Notice: Subject to any disclaimer, the term of this patent is extended or adjusted under 35 U.S.C. 154(b) by 340 days.

(21) Appl. No.: 14/158,592

(22) Filed: Jan. 17, 2014

(65) Prior Publication Data

US 2014/0203110 A1 Jul. 24, 2014

(30) Foreign Application Priority Data

Jan. 18, 2013 (DE) ..... 10 2013 200 751

(51) Int. Cl.
*F02M 61/14* (2006.01)
*F02M 37/00* (2006.01)

(52) U.S. Cl.
CPC ..... *F02M 37/0017* (2013.01); *F02M 61/14* (2013.01); *F02M 2200/306* (2013.01); *F02M 2200/853* (2013.01); *F02M 2200/856* (2013.01)

(58) Field of Classification Search
CPC ..... F02M 55/00; F02M 55/005; F02M 61/14; F02M 2200/856; F02M 37/0017; F02M 2200/306; F02M 2200/853
USPC ..... 239/584; 285/305; 123/456, 470
See application file for complete search history.

(56) References Cited

U.S. PATENT DOCUMENTS 4,993,390 A * 2/1991 Ono ..... F02M 55/004 123/456
5,074,269 A * 12/1991 Herbon ..... F02M 55/004 123/456
5,167,213 A * 12/1992 Bassler ..... F02M 61/145 123/456
5,501,195 A * 3/1996 Hall ..... F02M 61/145 123/470

(Continued)

FOREIGN PATENT DOCUMENTS

DE 102005020380 11/2006

*Primary Examiner* — Steven J Ganey
*Assistant Examiner* — Chee-Chong Lee
(74) *Attorney, Agent, or Firm* — Norton Rose Fulbright US LLP; Gerard Messina

(57) ABSTRACT

A connecting element for fuel injection systems is used for connecting a fuel injector to a fuel-carrying component. A connecting part is provided, which is fastened on the one side on a shoulder of the fuel-carrying component and, on the other side, on a shoulder of the fuel injector. For this purpose, the connecting part is developed at least partially as a pot spring. A fuel injection system having such a connecting element is also indicated.

13 Claims, 3 Drawing Sheets

(56) References Cited

U.S. PATENT DOCUMENTS

| | | | | | |
|---|---|---|---|---|---|
| 5,803,052 | A * | 9/1998 | Lorraine | F02M 69/465 | 123/456 |
| 5,893,351 | A * | 4/1999 | Akutagawa | F02M 51/005 | 123/456 |
| 5,909,725 | A * | 6/1999 | Balsdon | F02M 25/0836 | 123/470 |
| 5,970,953 | A * | 10/1999 | Lorraine | F02M 69/465 | 123/456 |
| 6,276,339 | B1 * | 8/2001 | Shebert, Jr. | F02M 61/14 | 123/470 |

* cited by examiner

FUEL INJECTION SYSTEM HAVING A FUEL-CARRYING COMPONENT, A FUEL INJECTOR AND A CONNECTING ELEMENT

FIELD OF THE INVENTION

The present invention relates to a connecting element for fuel injection systems for connecting a fuel injector to a fuel-carrying component, and it relates to a fuel injection system having such a connecting element. The present invention specifically relates to the field of fuel injection systems for mixture-compressing internal combustion engines having externally supplied ignition.

BACKGROUND INFORMATION

German Published Patent Appln. No. 10 2005 020 380 describes a fuel injection device, which is characterized by a noise-decoupling construction. The known fuel injection device includes a fuel injector, a receiving borehole for the fuel injector in a cylinder head and a fuel distributor line having a connection fitting. In this instance, the fuel injector is inserted into the connection fitting in a partially overlapping manner. The fuel injector is connected directly to the fuel distributor line via a connecting part, but is largely decoupled from the receiving borehole of the cylinder head. In one possible development, a pot-shaped sleeve is provided as the connecting part, which is situated securely and solidly on the downstream end of the connection fitting. The connecting part is developed in two parts, that is to say, it is made up of two semiannular ring elements. Each of the ring elements has a jacket section and a bottom section, the jacket section opposite the bottom section respectively transitioning into a hook-shaped latching section. The latching sections of the connecting part engage into two grooves on the circumference of the connection fitting. A middle opening is provided in the bottom section, through which a tapered region of the fuel injector penetrates, the tapered region having a conical edge as contact surface on the inlet fitting. A holding-down clamp is furthermore clamped between the bottom section of the connecting part and a shoulder on the fuel injector.

The development of the fuel injection device known from German Published Patent Appln. No. 10 2005 020 380 has the disadvantage that vibrations may be transmitted from the fuel injector to the connection fitting via the connecting part that is developed as a pot-shaped sleeve. Furthermore, the multi-part connecting part and the holding-down clamp must be suitably mounted together, which makes handling and especially mounting more difficult due to the multiplicity of the components involved.

Specifically in the case of electromagnetic high-pressure fuel injectors, which are used in Otto engines having direct injection, an obtrusive and disturbing contribution to the overall noise of the engine may occur, which may be described as valve ticking. Such valve ticking arises from the rapid opening and closing of the fuel injector, in which the valve needle is displaced in a highly dynamic way to the respective end stops. The impact of the valve needle on the end stops results in brief but very high contact forces which are transferred via a housing of the fuel injector to a fuel distributor rail in the form of structure-borne noise and vibrations. This results in a great noise generation.

SUMMARY

The connecting element according to the present invention and the fuel injection system according to the present invention have the advantage that an improved connection of the fuel injector to the fuel-carrying component is made possible, a noise reduction being achievable in the process. In particular, a soft connection of the fuel injector to the fuel-carrying component may be achieved.

The connecting element and the fuel injection system are especially suitable for applications for direct fuel injection. The fuel-carrying component is preferably developed in this instance as a fuel distributor, especially as a fuel distributor rail. On the one hand, such a fuel distributor may be used for distributing the fuel to a plurality of fuel injectors, especially high-pressure fuel injectors. On the other hand, the fuel distributor may be used as a common fuel store for the fuel injectors and store highly pressurized fuel. The fuel injectors are then preferably connected to the fuel distributor via corresponding connecting elements. In operation, the fuel injectors then inject the fuel required for the combustion process into the respective combustion chamber under high pressure.

The fuel injector is not a component part of the connecting element according to the present invention. Furthermore, the fuel-carrying component is not necessarily a component part of the connecting element. In particular, the connecting element according to the present invention may also be manufactured and marketed separately from the fuel-carrying component as well as from a fuel injector.

It is advantageous for the connecting part to have at a first end, on which the connecting part is on the one side fastened on the shoulder of the fuel-carrying component, at least one inner collar, which in the fastened state abuts at least indirectly against the shoulder of the fuel-carrying component. In this instance, the collar in the fastened state may contact the shoulder of the fuel-carrying component directly. It is particularly advantageous, however, for at least one plate-shaped elastic element to be provided and for the at least one inner collar on the first end of the connecting part in the fastened state to abut against the shoulder of the fuel-carrying component by way of the plate-shaped elastic element. An advantageous attachment of the connecting part on the fuel-carrying component is thus possible. In particular, a simple installation is made possible. Furthermore, an additional damping is achievable by the elastic element. For this purpose, other elements, in particular rigid elements, may also be provided, via which the inner collar abuts against the shoulder of the fuel-carrying component. Via such rigid elements, it becomes possible to achieve in particular a more homogeneous introduction of force into the plate-shaped elastic element. Moreover, it is advantageous that a second inner collar is provided on the first end of the connecting part, that the inner collar and the second inner collar lie across from each other, that an installation cut-out is provided on the first end of the connecting part, which extends between the first inner collar and the second inner collar perpendicular to a longitudinal axis of the connecting part, and that the second inner collar in the fastened state abuts at least indirectly on the shoulder of the fuel-carrying component. An installation of the connecting part on the fuel-carrying component is thereby simplified. In particular, a connection may be established in the installation by a process of plugging and subsequent twisting.

It is advantageous for the connecting part to have at a second end, on which the connecting part is on the other side able to be fastened on the shoulder of the fuel injector, at least one inner collar, which in the fastened state abuts at least indirectly against the shoulder of the fuel injector. It is furthermore advantageous in this connection for at least one plate-shaped elastic element to be provided and for the inner collar on the second end of the connecting part in the fastened state to abut against the shoulder of the fuel injector by way of the plate-shaped elastic element. Additional damping may be achieved in the process due to the plate-shaped elastic element. It is furthermore advantageous for the inner collar provided on the second end of the connecting part to be developed as a partially annular collar and for the partially annular collar to be interrupted on the second end of the connecting part by an installation opening. This allows for a simple installation, in which for example the fuel injector may be inserted in the area of the nozzle body laterally into the connecting part.

It is also advantageous that the connecting part has an at least hollow-cylindrical slotted pot wall. Specifically, it is advantageous in this regard that the hollow-cylindrical slotted pot wall is at least partially slotted in a meander form. The slots in this instance are advantageously offset with respect to one another such that comb-like webs are formed in the pot wall that effect a high flexibility of the connecting part along its longitudinal axis. By varying the number and design, in particular a width, of the slots, it is possible to set the stiffness to a great extent within a certain range. Even in the case of great wall thicknesses of the pot wall, sufficiently low stiffnesses may be achieved for acoustically decoupling the fuel injector from the fuel-carrying component. This also allows for additional degrees of freedom in the design of the connecting part. Moreover, lower stiffnesses of an attachment of the fuel injector are made possible while at the same time lowering the mechanical stress on the material of the connecting part.

DETAILED DESCRIPTION

Figure 1:
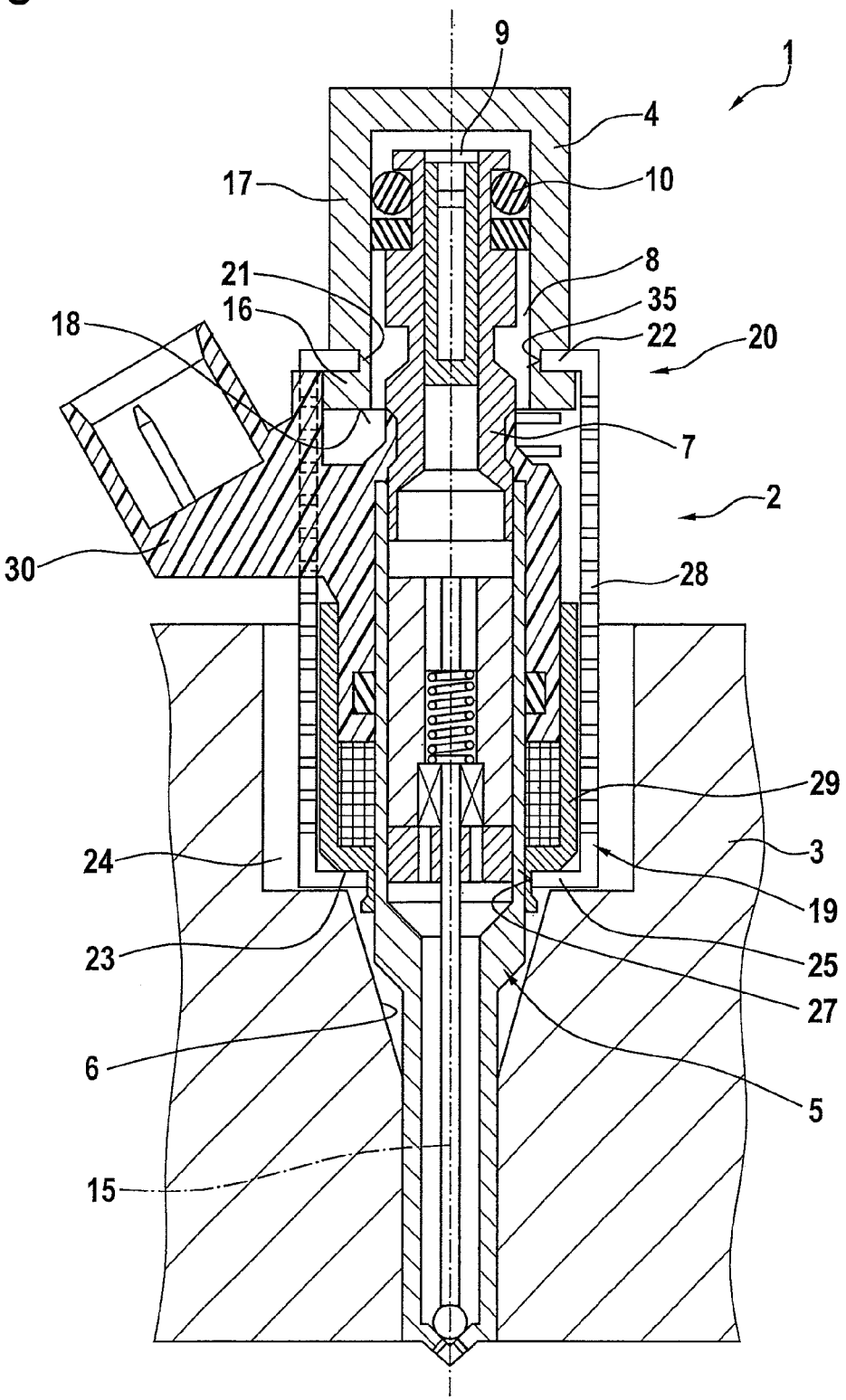
FIG. 1 shows a cross-sectional view of a fuel injection system having a connecting element corresponding to a first exemplary embodiment of the present invention and an internal combustion engine in an excerpted, schematic sectional representation.

FIG. 1 shows a fuel injection system 1 having a connecting element 2 corresponding to a first exemplary embodiment and an internal combustion engine 3 in an excerpted, schematic sectional representation.

Fuel injection system 1 may be particularly used for high-pressure injection in internal combustion engines 3. In particular, fuel injection system 1 may be used in mixture-compressing internal combustion engines 3 having externally supplied ignition. Connecting element 2 is particularly suitable for such a fuel injection system 1.

Fuel injection system 1 has a fuel-carrying component 4. This exemplary embodiment shows a cup 4 of fuel-carrying component 4. Fuel-carrying component 4 may also have a tubular distributor part, on which a plurality of such cups 4 is provided.

Fuel injection system 1 also has a fuel injector 5, which in the mounted state is situated in a borehole 6 of internal combustion engine 3. Fuel injector 5 includes a fuel fitting 7, which is at least partially inserted into receiving space 8 of cup 4. In the area of an inflow-side end 9 of fuel fitting 7, an O-shaped sealing ring is furthermore provided for sealing between fuel fitting 7 and cup 4.

In the mounted state, a longitudinal axis 15 is specified, which represents both the longitudinal axis 15 of receiving space 8 of cup 4 as well as longitudinal axis 15 of fuel injector 5. Connecting element 2 is likewise oriented with respect to longitudinal axis 15.

Cup 4 has at least one shoulder 16, which is developed on a pot-shaped base body 17 of cup 4. In this exemplary embodiment, shoulder 16 is provided on a lower edge 18 of pot-shaped base body 17. In particular, one such shoulder 16 may be provided respectively on two opposite sides on lower edge 18.

Connecting element 2 has a connecting part 19. On a first end 20, on which connecting part 19 is on the one side fastened to cup 4, connecting part 19 has a first inner collar 21 and a second inner collar 22 for fastening. Connecting part 19 abuts against the at least one shoulder 16 with first inner collar 21 and second inner collar 22, the at least one shoulder 16 being grasped from behind in the process.

Figure 3:
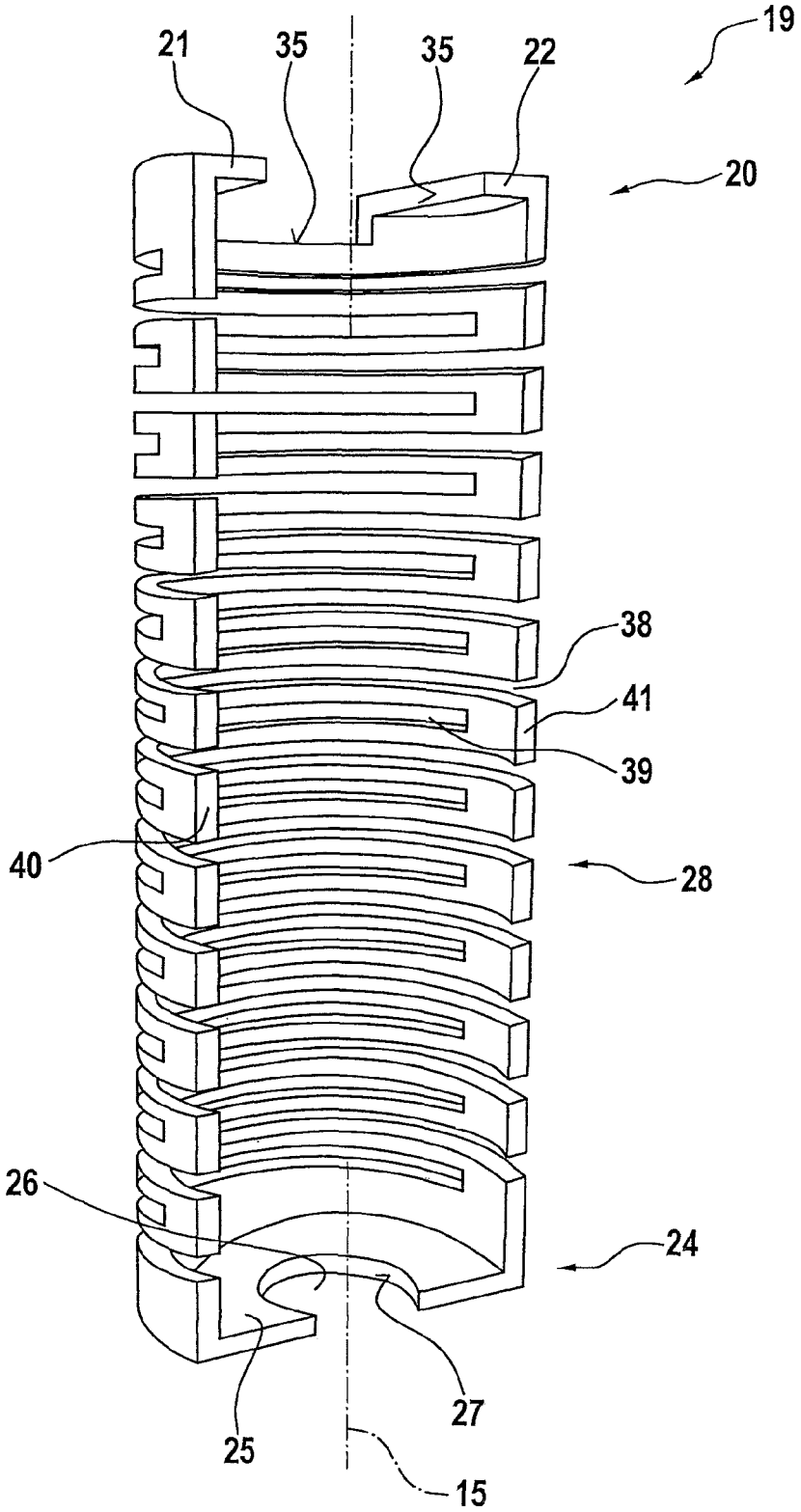
FIG. 3 shows a schematic perspective view of an alternative version of the connecting part of the connecting element of FIGS. 1 and 2 according to an alternative exemplary embodiment of the present invention.

Fuel injector 5 has at least one shoulder 23. Connecting part 19 is one the other side fastened to the at least one shoulder 23 of fuel injector 5. For this purpose, connecting part 19 has, for the purpose of fastening, at least one inner collar 25 on a second end 24, on which connecting part 19 is on the other side fastened to shoulder 23 of fuel injector 5. In this exemplary embodiment, inner collar 25 is developed as a partially annular collar 25. Collar 25 in this instance is developed in a partially annular manner with respect to longitudinal axis 15. The partially annular collar 25 has an installation opening 26, as shown in FIG. 3. Furthermore, a through-hole 27 is developed at the second end 24, through which fuel injector 5 is guided.

Inner collar 25 abuts against shoulder 23 of fuel injector 5.

Connecting part 19 has a pot wall 28. Pot wall 28 is preferably developed as a hollow-cylindrical pot wall 28. Connecting part 19 is developed at least partially as pot spring 19. It is advantageous in particular for connecting part 19 to be developed as a pot spring in the region of pot wall 28. A reliable connection of connecting element 2 with cup 4 on the one side and with fuel injector 5 on the other side is thereby achieved. In addition, an elastic development of connecting part 19 is achieved.

Connecting part 19 may be based on deep-drawn sheet steel. Fuel injector 5 guided through through-hole 27 of connecting part 19 is at least partially enclosed in this area by inner collar 25. As a result, inner collar 25 envelops shoulder 23 of fuel injector 5 in particular in the area of a magnetic cup 29 of fuel injector 5. Between connecting part 19, in particular inner collar 25, and internal combustion engine 3, particularly a cylinder head 3, there remains an air gap in the process such that in this location there is no contact between fuel injector 5 and internal combustion engine 3. This allows for a soft attachment of fuel injector 5.

On the first end 20 or upper edge 20, two segmental bearing surfaces are formed between first inner collar 21 and the at least one shoulder 16 as well as between second inner collar 22 and the at least one shoulder 16, on which connecting part 19 is connected with pot-shaped base body 17 of cup 4. In this instance, installation may be performed by a process of plugging and subsequent twisting such that pot-shaped base body 17 and connecting part 19 are oriented with reference to longitudinal axis towards each other. The connection may be developed as in the case of a bayonet catch.

For performing a plug connection 30 of fuel injector 5, connecting part 19 may have a suitable cut-out.

The spring effect may be achieved by the elasticity of pot wall 28 over a length from first end 20 to second end 24 as well as possibly a flexibility of inner collar 25. If applicable, a flexibility of first inner collar 21 and of second inner collar 22 may also be utilized. A wall thickness, in particular a thickness of pot wall 28, and a thickness of inner collar 25 (bottom 25) may be designed independently of each other in such a way that the desired stiffness results from possibly varying stretching and bending proportions.

In this exemplary embodiment, first inner collar 21 and second inner collar 22 are situated opposite each other on first end 20 with respect to longitudinal axis 15. An installation cut-out 35 is provided on first end 20, which extends between first inner collar 21 and second inner collar 22 perpendicular to longitudinal axis 15. Installation cut-out 35 simplifies the installation of connecting element 2 on cup 4.

Figure 2:
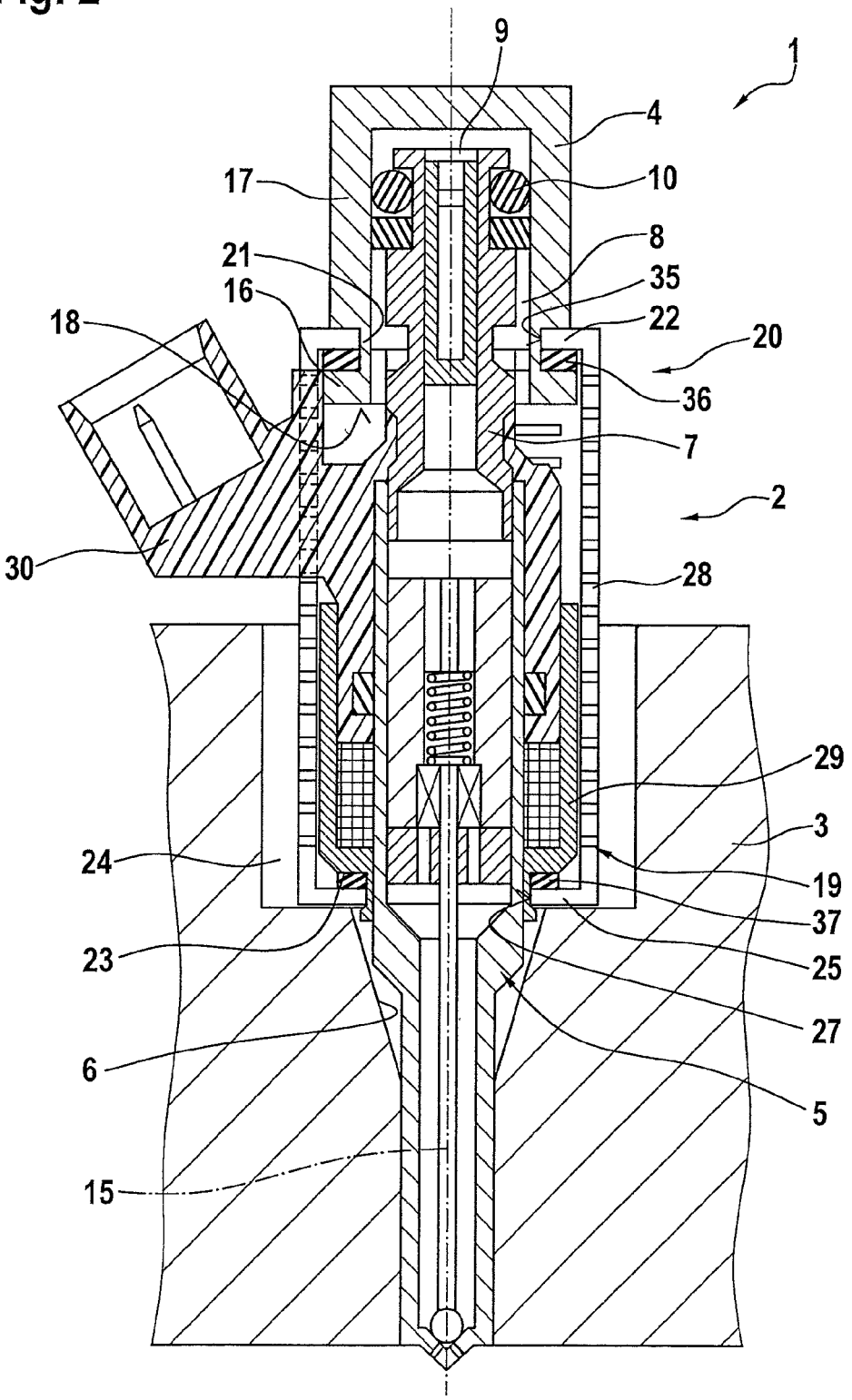
FIG. 2 shows a cross-sectional view of a fuel injection system having a connecting element corresponding to a second exemplary embodiment of the present invention and an internal combustion engine in an excerpted, schematic sectional representation.

FIG. 2 shows a fuel injection system 1 having a connecting element 2 corresponding to a second exemplary embodiment and an internal combustion engine 3 in an excerpted, schematic sectional representation. In this exemplary embodiment, a plate-shaped elastic element 36 is provided on first end 20, which is developed as an elastic support element 36. Plate-shaped elastic element 36 is situated between first inner collar 21 and shoulder 16 of cup 4 as well as between second inner collar 22 and shoulder 16 of cup 4. This allows for an elastic support on cup 4. A damping of vibrations is thereby further improved.

Furthermore, a plate-shaped elastic element 37 is situated on second end 24, which is developed as an elastic support element 37. Plate-shaped elastic element 37 is situated in this case between inner collar 25 and shoulder 23 of fuel injector 5. This ensures an elastic support in the area of second end 24.

Connecting part 19 is thus supported on the one side via plate-shaped elastic element 36 on shoulder 16 of cup 4 and on the other side via plate-shaped elastic element 37 on shoulder 23 of fuel injector 5.

In a modified development, it is also possible for only one of the plate-shaped elastic elements 36, 37 to be provided.

Plate-shaped elastic elements 36, 37 may be formed by spring steel sheets, in particular plate springs, plastic disks or metal wire meshworks or may be partially made of these. Additional compensation disks may be provided for distributing the contact pressure, which may be provided in particular between inner collars 21, 22 and plate-shaped elastic element 36 and/or between inner collar 25 and plate-shaped elastic element 37. Plate-shaped elastic elements 36, 37 produce additional elasticity. If required, this allows also for a greater wall thickness, in particular sheet metal thickness, of connecting part 19, in particular of pot wall 28. A stiffer design of the pot-shaped base body 17 become thus possible since an additional elasticity is achieved via elements 36, 37. At the same time, this allows for a reduction of the mechanical stresses in connecting part 19.

FIG. 3 shows a schematic perspective view of the connecting part 19 of the connecting element 2 according to an alternative exemplary embodiment. Connecting part 19 has a hollow-cylindrical slotted pot wall 28, and, in this instance, pot wall 28 is slotted in a meander form. For this purpose, multiple slots 38, 39 are developed in pot wall 28, FIG. 3 only indicating slots 38, 39 for the sake of simplifying the representation. Slots 38, 39 extend in a circumferential direction about longitudinal axis 15. Viewed along longitudinal axis 15, slots 38, 39 start out respectively alternating from a side 40 and a side 41 into pot wall 28 and end respectively at a distance from the respectively other side 40, 41. Slot 38, for example, extends from side 41 in the circumferential direction through pot wall 28 and ends before reaching side 40. Slot 39, by contrast, extends from side 40 and ends before reaching side 41. In this exemplary embodiment, a meander-shaped development of pot wall 28 is thereby achieved. Slots 38, 39 are offset with respect to each other such that comb-like webs are created in pot wall 28, which effect a high flexibility of the pot in the direction of longitudinal axis 15.

The respectively chosen geometry allows for a specification of the desired stiffness or elasticity within certain limits. In particular, the stiffness of connecting part 19 may be adjusted to a great extent by varying the number and width of slots 38, 39. Even in the case of great wall thicknesses of pot wall 28, sufficiently low stiffnesses may be thereby achieved for acoustically decoupling fuel injector 5 from fuel-carrying component 4, in particular cup 4, as well as a possibly provided fuel distributor rail or the like. This development thus allows for additional degrees of freedom in the design of pot wall 28 that acts as pot spring 28. Fundamentally lower stiffnesses of the attachment are thus made possible, while at the same time the material of pot wall 28 experiences less mechanical stress.

Specific embodiments are thus described with reference to FIGS. 1 through 3, in which connecting part 19 is developed at least partially as pot spring 19; 28. In particular, pot wall 28 may be developed as pot spring 28. For this purpose, the developments described may also be combined in another manner. Specifically, in the exemplary embodiment described with reference to FIG. 3, a modification may also be made such that one or multiple plate-shaped elastic elements 36, 37 are provided on first end 20 or on second end 24.

In designing connecting part 19, it is in particular possible to specify a spring stiffness of no more than 50 kN/mm for the spring effect between fuel injector 5 and fuel-carrying component 4. This results in an advantageous installation option, since in particular an installation by a plug-twist motion is made possible. The attachment 2 mediated by connecting element 2 may thus be installed or uninstalled simply and quickly.

The present invention is not limited to the specific embodiments described.

What is claimed is:

1. A connecting device for a fuel injection system for connecting a fuel injector to a fuel-carrying component, comprising:

a connecting part including:

a first end adapted to be fastened on at least one shoulder of the fuel-carrying component, and a second end adapted to be fastened on at least one shoulder of the fuel injector, wherein the connecting part includes a hollow-cylindrical slotted wall having a plurality of slots, wherein adjacent slots of the plurality of slots alternate opening from a first side of the hollow-cylindrical slotted wall and a second side of the hollow-cylindrical slotted wall, wherein slots that open from the first side of the hollow-cylindrical slotted wall end at a distance from the second side, and slots that open from the second side of the hollow-cylindrical slotted wall end at a distance from the first side.

2. The connecting device as recited in claim 1, wherein the connecting part includes, at the first end, at least one first inner collar that in a fastened state is adapted to abut at least indirectly against the at least one shoulder of the fuel-carrying component.

3. The connecting device as recited in claim 2, further comprising:

at least one plate-shaped elastic element, wherein the at least one first inner collar at the first end of the connecting part in the fastened state abuts against the at least one shoulder of the fuel-carrying component by way of the at least one plate-shaped elastic element.

4. The connecting device as recited in claim 2, further comprising:

a second inner collar provided on the first end, wherein:

the at least one first inner collar and the second inner collar lie across from each other, an installation cut-out is provided on the first end and extends between the at least one first inner collar and the second inner collar perpendicular to a longitudinal axis of the connecting part, and the second inner collar in a fastened state is adapted to abut at least indirectly on the at least one shoulder of the fuel-carrying component.

5. The connecting device as recited in claim 1, wherein the connecting part includes, at the second end, at least one inner collar that in a fastened state is adapted to abut at least indirectly against the at least one shoulder of the fuel injector.

6. The connecting device as recited in claim 5, further comprising:

at least one plate-shaped elastic element, wherein the inner collar at the second end of the connecting part in the fastened state abuts against the shoulder of the fuel injector by way of the plate-shaped elastic element.

7. The connecting device as recited in claim 5, wherein the at least one inner collar provided on the second end includes a partially annular collar that is interrupted on the second end of the connecting part by an installation opening.

8. The connecting device as recited in claim 1, wherein the hollow-cylindrical slotted wall is slotted at least partially in a meander form.

9. The connecting device as recited in claim 1, wherein the hollow-cylindrical slotted wall is elastic over an entire length from the first end to the second end.

10. The connecting device as recited in claim 1, wherein adjacent slots of the plurality of slots are offset with respect to one another.

11. A fuel injection system, comprising:

at least one fuel-carrying component;

at least one fuel injector; and at least one connecting device, the at least one fuel injector connected to the at least one fuel-carrying component via the at least one connecting element, the at least one connecting element including:

a first end adapted to be fastened on at least one shoulder of the at least one fuel-carrying component, and a second end adapted to be fastened on at least one shoulder of at least one the fuel injector, wherein the at least one connecting element includes a hollow-cylindrical slotted wall having a plurality of slots, wherein adjacent slots of the plurality of slots alternate opening from a first end of the hollow-cylindrical slotted wall and a second end of the hollow-cylindrical slotted wall, wherein slots that open from the first side of the hollow-cylindrical slotted wall end at a distance from the second side, and slots that open from the second side of the hollow-cylindrical slotted wall end at a distance from the first side.

12. The fuel injection system as recited in claim 11, wherein the fuel injection system is adapted for a mixture-compressing internal combustion engine having an externally supplied ignition.

13. The fuel injection system as recited in claim 11, wherein the hollow-cylindrical slotted wall is elastic over an entire length from the first end to the second end.

* * * * *